US007131152B2

(12) United States Patent
Wootten, Jr. et al.

(10) Patent No.: US 7,131,152 B2
(45) Date of Patent: Nov. 7, 2006

(54) BED SHEET WITH SIDE POCKET

(76) Inventors: Gerald E. Wootten, Jr., 298 County Rd. 1468, Cullman, AL (US) 35038; Gerald E. Wootten, III, 298 County Rd. 1468, Cullman, AL (US) 35038

( * ) Notice: Subject to any disclaimer, the term of this patent is extended or adjusted under 35 U.S.C. 154(b) by 0 days.

(21) Appl. No.: 11/225,944

(22) Filed: Sep. 14, 2005

(65) Prior Publication Data

US 2006/0075556 A1 Apr. 13, 2006

Related U.S. Application Data

(60) Provisional application No. 60/609,272, filed on Sep. 14, 2004.

(51) Int. Cl.
*A47G 9/02* (2006.01)

(52) U.S. Cl. ..... 5/485; 5/694

(58) Field of Classification Search ..... 5/485, 5/493, 694; 2/247, 250
See application file for complete search history.

(56) References Cited

U.S. PATENT DOCUMENTS 3,425,062 A * 2/1969 Saad ..... 2/227
4,671,568 A * 6/1987 Greer ..... 297/229
4,791,681 A * 12/1988 Dean ..... 2/106
4,892,353 A * 1/1990 Goddard ..... 297/224
5,111,544 A 5/1992 Graebe
5,279,009 A 1/1994 Putka, Jr.
5,517,696 A * 5/1996 Krugler ..... 2/250
5,557,814 A 9/1996 Cybulski
6,178,574 B1 1/2001 Stromatt et al.
D471,049 S 3/2003 Dale
6,594,836 B1 7/2003 Everson et al.
6,601,250 B1 8/2003 Taylor
D481,899 S 11/2003 Thomas et al.
6,684,422 B1 * 2/2004 LeFevre et al. ..... 5/496

* cited by examiner

*Primary Examiner*—Michael Trettel
(74) *Attorney, Agent, or Firm*—Dykema Gossett PLLC

(57) ABSTRACT

An improved pocketed bed sheet is provided that avoids inadvertent placement of objects in a pocket, better controls placement and removal of objects from within its pocket, and deters babies and toddlers from accessing such pocket, all without the need for engagement or disengagement of a fastening member. The improved pocketed bed sheet includes a fabric body configured to substantially cover a mattress and a pocket provided on the fabric body. The pocket includes a wall configured to hold objects in the pocket and a diagonal fabric edge that defines a diagonal opening for predetermined angular ingress and egress into the pocket for controlling the placement and removal of objects within the pocket. The diagonal fabric edge is disposed at an angle relative to an edge of the fabric body.

17 Claims, 3 Drawing Sheets

BED SHEET WITH SIDE POCKET

RELATED APPLICATIONS

The present application claims the benefit of priority to U.S. Provisional Patent Application Ser. No. 60/609,272, filed Sep. 14, 2004, hereby incorporated by reference in its entirety.

BACKGROUND OF INVENTION a. Field of Invention

The invention relates generally to pocketed bed sheets, and, more particularly to a bed sheet having side pockets designed for predetermined ingress and egress for thereby controlling placement of and removal of objects from within the pockets.

b. Description of Related Art

In the art, there presently exist a variety of known bed sheets for mattresses, with the sheets having pockets and the like for placement and/or organization of objects. The typical pocketed bed sheet includes one or more side pockets having an opening at a top area thereof for storage of objects such as television remote-controls, keys and other such objects. Other forms of pocketed bed sheets include pockets with zippers, buttons or other forms of means for closing the pockets.

Known prior art bed sheets are disclosed for example in U.S. Pat. No. 6,594,836 to Everson, et al., U.S. Pat. No. 6,601,250 to Taylor, U.S. Pat. No. 6,178,574 to Stromatt, U.S. Pat. No. 5,279,009 to Putka, U.S. Pat. No. 5,557,814 to Cybulski, U.S. Pat. No. 5,111,544 to Graebe, D471,049 to Dale, and D481,899 to Thomas, the respective disclosures of which are incorporated herein by reference.

U.S. Pat. No. 6,594,836 to Everson discloses a bed sheet with convenience pouches having elastic pockets. FIG. 1 of Everson shows a typical fitted bottom sheet 10 with a convenience pouch 12 attached on side 14 of sheet 10. Pouch 12 includes a single longitudinal pocket, or may be divided into a plurality of smaller pockets 16 by the provision of vertical seams 18. Alternatively, a plurality of pockets may be separately provided as desired. Furthermore, sheet 10 and pouches 12 are made in such a manner as to allow items to be slipped into the pouch 12 or retrieved through an elasticized opening 26 at the top of the pouch 12.

One exemplary drawback of the convenience pouches disclosed by Everson is that objects can be inadvertently dropped into the pockets. More importantly, for homes with babies and toddlers, it is often necessary to provide means for preventing inadvertent placement of objects in pockets and other such areas. It is also necessary to provide means for deterring babies and toddlers from accessing such pockets and removing objects therefrom. The present invention thus purports to overcome at least the aforementioned exemplary drawbacks of the pockets disclosed by Everson.

Another type of pocketed bed sheet is disclosed by U.S. Pat. No. 6,601,250 to Taylor. As shown in FIGS. 1 and 2 of Taylor, each of the pocket members 14 includes elastic bands 17 disposed along top edges of the front and side walls 15,16 for closing the opening to secure objects and items in pocket member 14. The pockets further contain fastening members 20, which are strips of hook and loop fasteners attached inside the pocket members 14 for securely closing the pockets.

While the pocketed bed sheet of Taylor overcomes some of the noted drawbacks of the convenience pouches disclosed by Everson, when the pockets of Taylor are disposed in the closed position by means of fastening members 20, the fastening members must be disengaged to enable objects to be placed into the pockets. Thus, the additional step of disengaging fastening members 20 is required before an object can be placed in the pocket for Taylor, and furthermore, the additional step of disengaging fastening members 20 is required in order to remove an object.

It would therefore be of benefit to provide a bed sheet having side pockets designed for predetermined ingress and egress for thereby controlling placement of and removal of items from within the pockets, without the need for engagement or disengagement of a fastening member. It would also be of benefit to provide a pocketed bed sheet which deters the inadvertent placement of objects in the pockets, for homes especially with babies and toddlers, and further having a means for deterring babies and toddlers from accessing such pockets and removing objects therefrom. There also remains a need for a pocketed bed sheet having side pockets which are simpler and more economical to manufacture, utilize less raw material, and are ergonomically superior to those of the prior art.

SUMMARY OF INVENTION

The present invention provides a bed sheet, the bed sheet including a fabric body configured to substantially cover a mattress and a pocket provided on the fabric body, where the pocket comprises a wall configured to hold objects in the pocket and a diagonal fabric edge. The diagonal fabric edge may define a diagonal opening for predetermined angular ingress and egress into the pocket for controlling placement and removal of objects from within the pocket and may be disposed at an angle relative to an edge of the fabric body.

The pocket may comprise two side walls, with one of the side walls having a shorter length than the other of the side walls, a bottom wall joining the side walls and configured to hold objects in the pocket, and a top wall connected to one of the side walls. The diagonal fabric edge may extend from the shorter of the side walls to the top wall. The length of the shorter of the side walls may be about one-half of the length of the other of the side walls. The length of the top wall may be about one-half of the length of the bottom wall.

The fabric body may comprise a top portion, side portions, and end portions. Adjacent side and end portions may be seamed together to form vertical corners. The vertical corners may be formed by a straight line of stitching and a safety stitch. The side portions and the end portions may include upper edge portions and lower edge portions terminating in lower edges extending lengthwise thereof and spaced from the top portion, the lower edges joining one another to form a continuous lower edge of the sheet. An elastic binding may be disposed around said lower edges. The elastic binding may extend along the entire length of said lower edges. The fabric body may be a fitted sheet.

The pocket may be provided on one of the side portions of the fabric body. A second pocket may be provided on another one of the side portions of the fabric body. The diagonal fabric edge may include an elastic lining for retaining the diagonal fabric edge near the fabric body when an object is placed in the pocket to deter access to the object. The diagonal fabric edge may include first and second layers of fabric and the elastic lining may be enclosed between the first and second layers of fabric.

The pocket may comprise a curved wall configured to hold objects in the pocket. The diagonal fabric edge may extend from one end of the curved wall to another end of the curved wall.

The present invention also provides a pocket device for a furniture covering. The pocket device may include an outer edge configured to form a substantially enclosed area and attach the pocket device to the furniture covering. The pocket device may further include a fabric edge extending from an end of the outer edge to another end of the outer edge. The fabric edge may define a diagonal opening disposed at an angle relative to an edge of the furniture covering. The diagonal opening may enable predetermined angular ingress and egress into the pocket device for controlling placement and removal of objects within the pocket device. The outer edge may include two side edges, a bottom edge joining the side edges, and a top edge connected to one of the side edges. The length of one of the side edges is about one-half the length of the other of the side edges. The length of the top edge is about one-half the length of the bottom edge.

The fabric edge may extend from the shorter of the side edges to the top edge. The fabric edge may include an elastic lining for retaining the fabric edge near the furniture covering when an object is placed in the pocket device to deter access to the object. The furniture covering may be a bed linen, a bed sheet, a bed comforter, a duvet, a sham, a bed skirt, or a slip cover.

The present invention also provides a furniture covering. The furniture covering may include a fabric body configured to cover at least a portion of a piece of furniture. The furniture covering may further include a pocket provided on the fabric body. The pocket may include a wall configured to hold objects in the pocket and a diagonal fabric edge. The diagonal fabric edge may define a diagonal opening for predetermined angular ingress and egress into the pocket for controlling placement and removal of objects from within the pocket and may be disposed at an angle relative to an edge of the fabric body.

The invention solves the problems and overcomes the drawbacks and deficiencies of prior art pocketed sheets by providing a bed sheet having side pockets designed for predetermined ingress and egress for thereby controlling placement of and removal of items from within the pockets, without the need for engagement or disengagement of a fastening member.

Thus an object of the present invention is to provide a pocketed bed sheet which deters the inadvertent placement of objects in the pockets, for homes especially with babies and toddlers, and further having a means for deterring babies and toddlers from accessing such pockets and removing objects therefrom.

Another object of the present invention is to provide a pocketed bed sheet having side pockets which are simpler and more economical to manufacture, utilize less raw material, and are ergonomically superior to those of the prior art.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT

Figure 1:
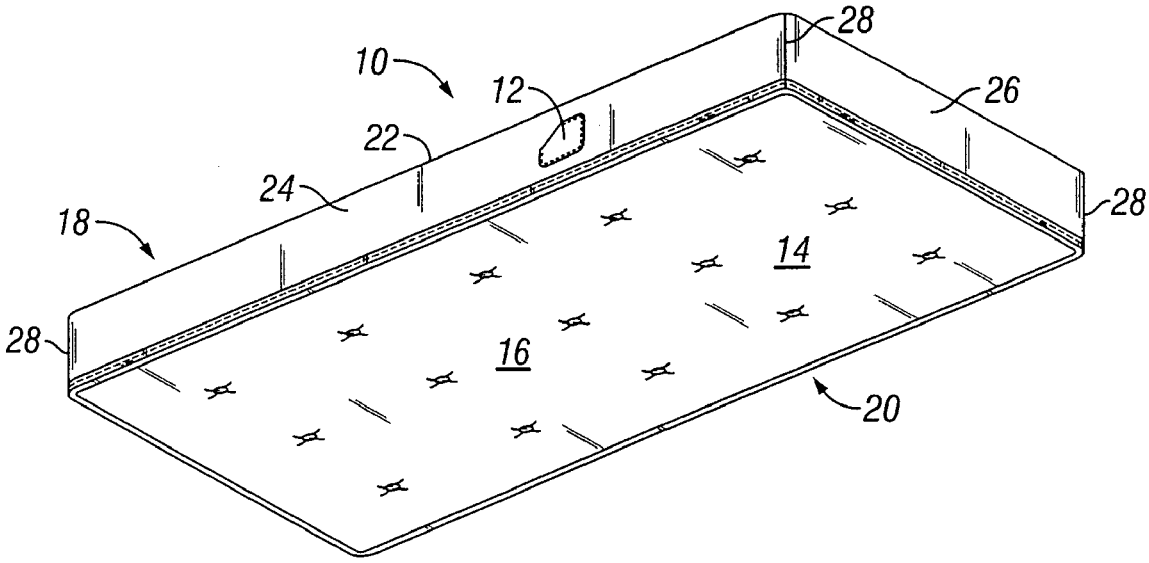
FIG. 1 is a perspective view of a mattress having a pocketed bed sheet according to the present invention mounted thereon.

Referring now to the drawings wherein like reference numerals designate corresponding parts throughout the several views, FIGS. 1–4 illustrate a pocketed bed sheet having ingress/egress deterrent pockets according to the present invention.

Figure 2:
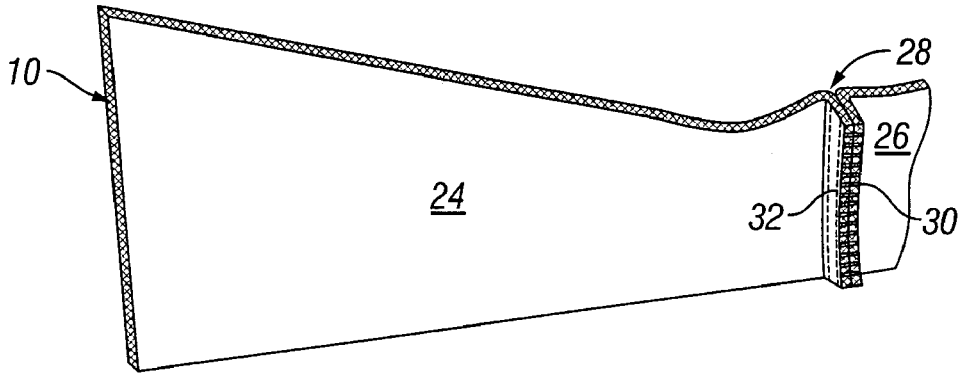
FIG. 2 is an enlarged perspective view of the pocketed bed sheet of FIG. 1, illustrating the edges of the pocketed bed sheet.

Specifically, as shown in FIG. 1, pocketed bed sheet 10 including a plurality of side pockets 12 (one illustrated in FIG. 1) is illustrated as being mounted on a conventional rectangular mattress 14 having a bottom face 16 and an opposite upper face 18. For the fitted bed sheet illustrated in FIG. 1, an elastic binding (not shown) may be disposed around the lower edge of the bed sheet and extend along the entire length of the lower edge of the sheet so that the lower edge includes an elastic ruffled edge 19. Ruffled edge 19 is best viewed in FIGS. 3–4. Pocketed bed sheet 10 generally comprises a body 20 formed of any suitable fabric such as cotton, a cotton blend or satin and the like. While these fabrics are particularly described, it is understood by those of ordinary skill in the art that various other fabrics may be used and remain within the spirit and scope of the invention. Body 20 may include a top portion 22, opposite side portions 24 and opposite end portions 26. Adjacent side and end portions may be seamed together in the usual manner at four seams to form four vertical corners 28. As seen in FIG. 2, each seam defining a vertical corner 28 may include a straight line of stitching 30 and a conventional overlock or safety stitch 32.

Figure 3:
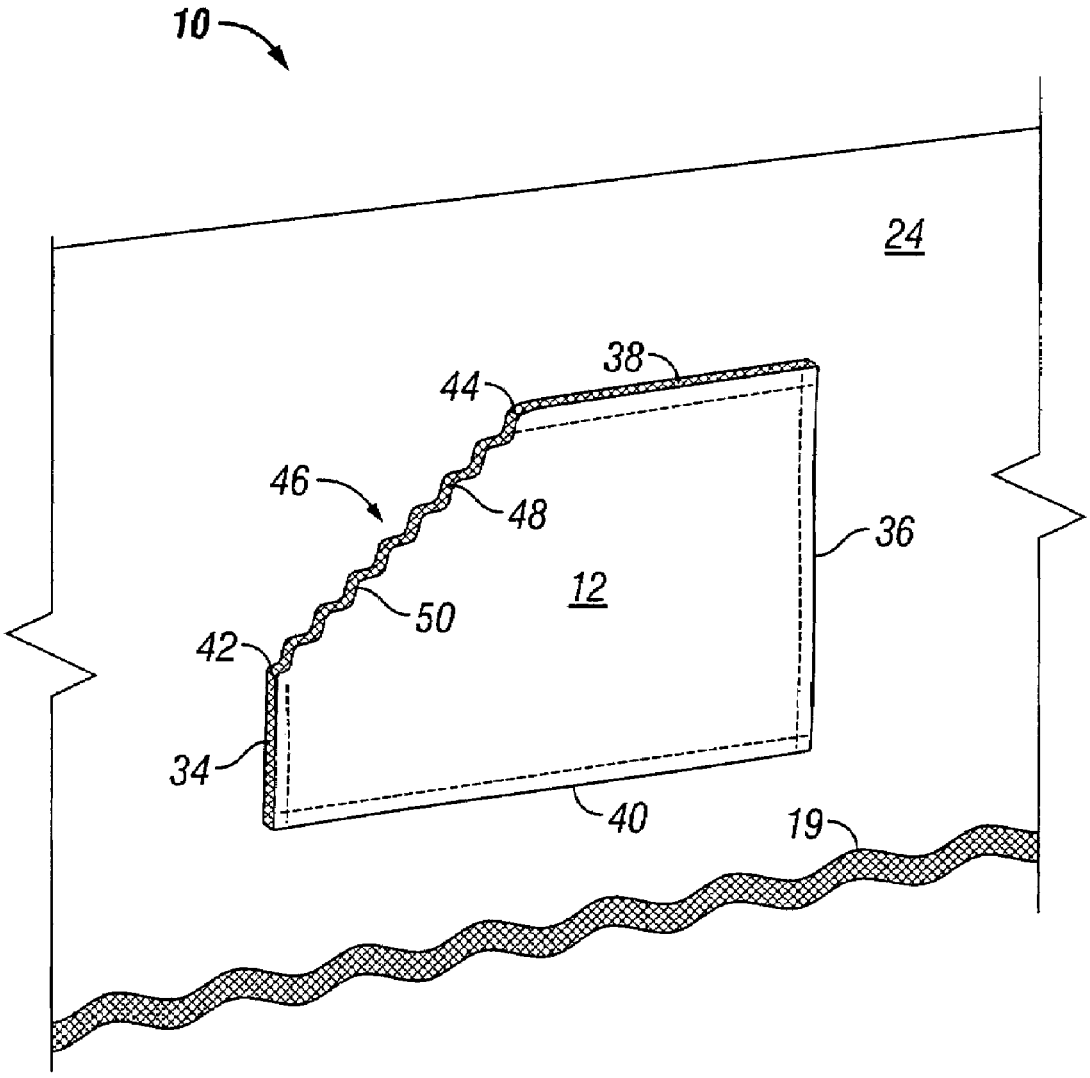
FIG. 3 is an enlarged illustrative view of the pocketed bed sheet of FIG. 1, illustrating the various contours of an ingress/egress deterrent pocket.

Referring to FIG. 3 showing a first embodiment of pocketed bed sheet 10, each pocket 12 may include side walls 34, 36, and respective top and bottom walls 38, 40, which when attached to side portion 24, form a partially enclosed compartment within pocket 12. As shown in FIG. 3, side wall 34 may extend approximately one-half of the length of the entire height of pocket 12 defined by side wall 36. Likewise, top wall 38 may extend approximately one-half of the length of the entire width of pocket 12 defined by bottom wall 40. Although walls 34 and 38 are described as approximately one-half the length of side wall 36 and bottom wall 40, respectively, it is understood by those of ordinary skill in the art that walls 34 and 38 may be any fraction of the length of side wall 36 and bottom wall 40, and remain within the spirit and scope of the invention. In this manner, corners 42 and 44 of walls 34, 38, respectively, form ends for diagonal opening 46 defined by edge 48. In the embodiment shown, the edges forming walls 34, 36, 38 and 40 may be sewn by a single or double stitch for attachment of pocket 12 onto side portion 24.

Figure 4:
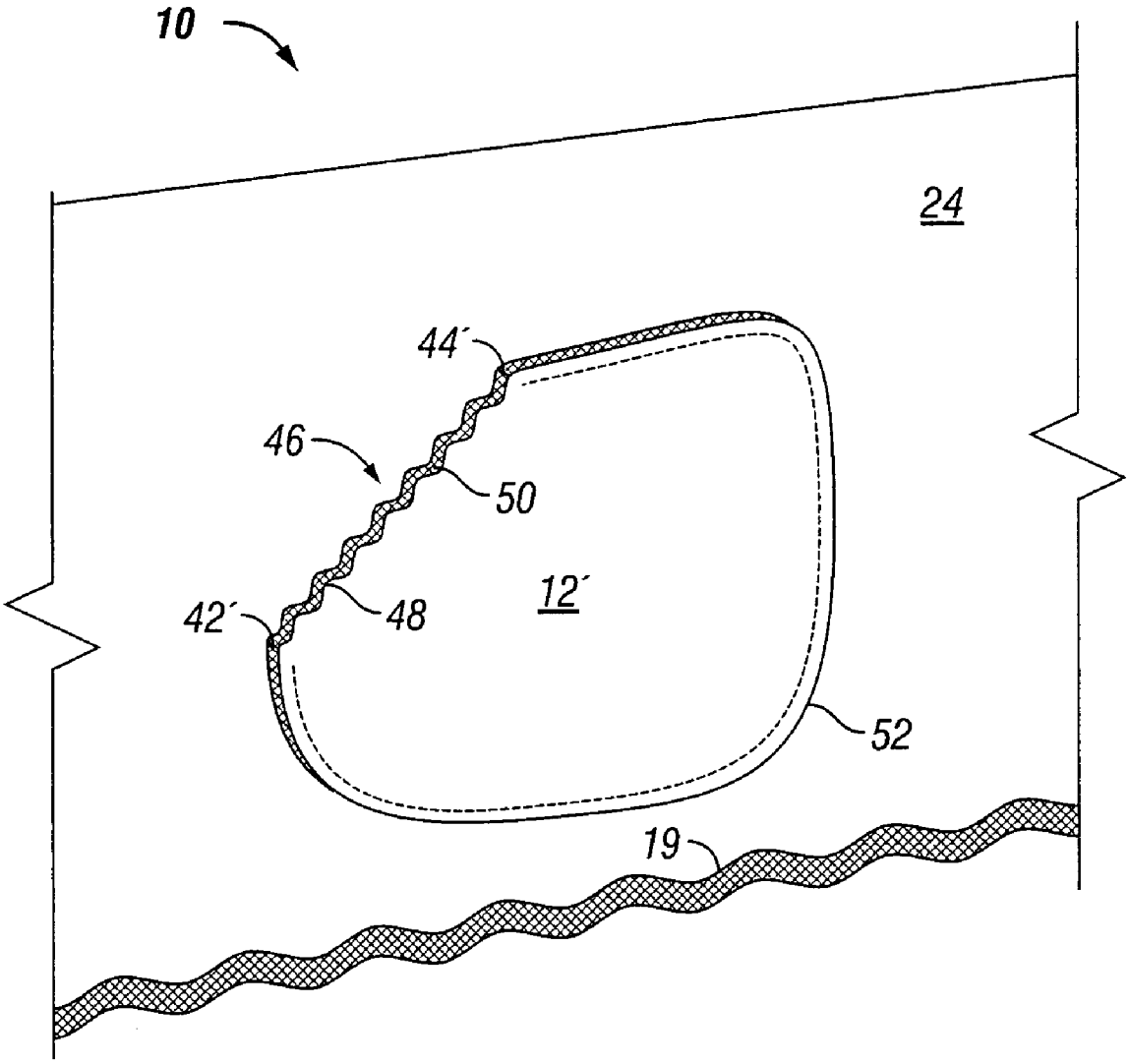
FIG. 4 is an enlarged illustrative view of a second exemplary embodiment of the pocketed bed sheet of FIG. 1, illustrating the various contours of an ingress/egress deterrent pocket.

Referring now to FIG. 4 showing a second exemplary embodiment of pocketed bed sheet 10' according to the present invention, each pocket 12' may include a wall 52, which when attached to side portion 24, forms a partially enclosed compartment within pocket 12'. As shown in FIG. 4, wall 52 may be curved, creating an approximate semicircle. In this manner, ends 42' and 44' of wall 52 form ends for diagonal opening 46 defined by edge 48. In the embodiment shown, the edge forming wall 52 may be sewn by a single or double stitch for attachment of pocket 12' onto side portion 24.

In order to provide a suitable means for predetermined ingress and egress into side pockets 12, 12', edge 48 may include an elastic lining (not shown). The elastic lining may be formed of conventional material used for such elastic lining material in fitted sheets. In order to provide a secure means for enclosing the elastic lining, pockets 12, 12' may be formed of two layers of fabric material folded over along the length of edge 48 so that the elastic lining may be enclosed between the two fabric materials and stitched between the two fabric layers at stitch line 50. As described above for walls 34, 36, 38, 40, and 52, stitch line 50 may be a single or double stitch. Pockets 12, 12' may be entirely formed of elastic in order to provide suitable means for predetermined ingress and egress.

Based upon the provisions of top wall 38 (FIG. 3) or wall 52 (FIG. 4) and diagonal opening 46, pockets 12, 12' may thus include suitable means for predetermined ingress and egress into the pockets for thereby controlling placement of and removal of objects from within the pockets, without the need for engagement or disengagement of a fastening member. Specifically, top wall 38 or wall 52 may provide a means for deterring inadvertent placement of objects in the pockets, since an object may only be placed into the pockets by diagonal entry through diagonal opening 46. Once disposed in pockets 12, 12', elastic edge 48 of opening 46 may snap back to enclose the object within the pocket, to thereby provide a means for deterring access to the object. In order to remove objects disposed in pockets 12, 12', elastic edge 48 may be stretched outwards to access and remove objects. Diagonal opening 46 thus requires predetermined angular insertion and removal of objects from within pockets 12, 12'. Diagonal opening 46, by means of elastic edge 48, thus also provides a means for enclosing an object in the compartment of pockets 12, 12' and deterring access to the compartment.

For the pocketed bed sheets illustrated in FIGS. 3–4, although only one pocket is illustrated on sheet 10, 10' those skilled in the art would appreciate in view of this disclosure that sheet 10, 10' may include a plurality of pockets disposed thereon. In an exemplary embodiment, mirror image pockets may be disposed on opposite side portions 24 of sheet 10, 10' for access to objects disposed in the pockets from either side of mattress 14.

Based upon the discussion above, the pocketed bed sheet of the present invention thus solves the problems and overcomes the drawbacks and deficiencies of prior art pocketed sheets by providing a pocketed bed sheet having side pockets designed for predetermined ingress and egress for thereby controlling placement of and removal of items from within the pockets, without the need for engagement or disengagement of a fastening member. Pocketed bed sheet 10, 10' also deters the inadvertent placement of objects in the pockets, for homes especially with babies and toddlers, and further includes elastic edge 48 for deterring babies and toddlers from accessing such pockets and removing objects therefrom.

Although pockets 12, 12' according to the present invention have been illustrated as being provided on a fitted sheet in FIG. 1, those skilled in the art would appreciate in view of this disclosure that pockets 12, 12' may be likewise provided on a flat sheet, bed linens, a furniture cover and the like and remain within the spirit and scope of the invention.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A bed sheet, comprising:

a fabric body configured to substantially cover a mattress; and a pocket provided on said fabric body, said pocket comprising two side walls, one of said side walls having a shorter length than the other of said side walls; a bottom wall joining said side walls and configured to hold objects in said pocket; a top wall connected to one of said side walls; and a diagonal fabric edge defining a diagonal opening for predetermined angular ingress and egress into said pocket for controlling placement and removal of objects from within said pocket, wherein said diagonal fabric edge extends from the shorter of said side walls to said top wall and said diagonal fabric edge is disposed at an angle relative to an edge of said fabric body.

2. A bed sheet according to claim 1 wherein the length of said shorter of said side walls is about one-half of the length of the other of said side walls.

3. A bed sheet according to claim 1 wherein the length of said top wall is about one-half of the length of said bottom wall.

4. A bed sheet according to claim 1, wherein said fabric body comprises:

a top portion, side portions, and end portions, wherein adjacent side and end portions are seamed together to form vertical corners.

5. A bed sheet, comprising:

a fabric body configured to substantially cover a mattress, wherein said fabric body comprises a top portion, side portions, and end portions, wherein adjacent side and end portions are seamed together to form vertical corners and wherein said vertical corners are formed by a straight line of stitching and a safety stitch; and a pocket provided on said fabric body, wherein said pocket comprises a wall configured to hold objects in said pocket and a diagonal fabric edge defining a diagonal opening for predetermined angular ingress and egress into said pocket for controlling placement and removal of objects from within said pocket, said diagonal fabric edge disposed at an angle relative to an edge of said fabric body.

6. A bed sheet according to claim 5 wherein said side portions and said end portions include upper edge portions and lower edge portions terminating in lower edges extending lengthwise thereof and spaced from said top portion, said lower edges joining one another to form a continuous lower edge of said sheet.

7. A bed sheet according to claim 6, wherein an elastic binding is disposed around said lower edges.

8. A bed sheet according to claim 7, wherein said elastic binding extends along the entire length of said lower edges.

9. A bed sheet according to claim 5, wherein said pocket is provided on one of said side portions of said fabric body.

10. A bed sheet according to claim 9, further comprising a second pocket provided on another of one of said side portions of said fabric body.

11. A bed sheet, comprising:

a fabric body configured to substantially cover a mattress, wherein said fabric body is a fitted sheet; and a pocket provided on said fabric body, wherein said pocket comprises a wall configured to hold objects in said pocket and a diagonal fabric edge defining a diagonal opening for predetermined angular ingress and egress into said pocket for controlling placement and removal of objects from within said pocket, said diagonal fabric edge disposed at an angle relative to an edge of said fabric body.

12. A bed sheet according to claim 11, wherein said pocket comprises:

a curved wall configured to hold objects in said pocket, wherein said diagonal fabric edge extends from one end of said curved wall to another end of said curved wall.

13. A bed sheet, comprising:

a fabric body configured to substantially cover a mattress; and a pocket provided on said fabric body, wherein said pocket comprises a wall configured to hold objects in said pocket and a diagonal fabric edge defining a diagonal opening for predetermined angular ingress and egress into said pocket for controlling placement and removal of objects from within said pocket, said diagonal fabric edge disposed at an angle relative to an edge of said fabric body and wherein said diagonal fabric edge includes an elastic lining for retaining said diagonal fabric edge near said fabric body when an object is placed in said pocket to deter access to said object.

14. A pocket device for a furniture covering, comprising:

an outer edge configured to form a substantially enclosed area and attach said pocket device to said furniture covering, wherein said outer edge includes two side edges, a bottom edge joining said side edges, and a top edge connected to one of said side edges and wherein the length of one of said side edges is about one-half the length of the other of said side edges and the length of said top edge is about one-half the length of said bottom edge; and a fabric edge extending from an end of said outer edge to another end of said outer edge, said fabric edge defining a diagonal opening disposed at an angle relative to an edge of said furniture covering, wherein said diagonal opening enables predetermined angular ingress and egress into said pocket device for controlling placement and removal of objects within said pocket device.

15. A pocket device according to claim 14 wherein said fabric edge extends from the shorter of said side edges to said top edge.

16. A pocket device according to claim 14 wherein said fabric edge includes an elastic lining for retaining said fabric edge near said furniture covering when an object is placed in said pocket device to deter access to said object.

17. A pocket device according to claim 14, wherein said furniture covering is one of a bed linen, a bed sheet, a bed comforter, a duvet, a sham, a bed skirt, and a slip cover.

* * * * *